US006417616B2

(12) United States Patent
Lee

(10) Patent No.: US 6,417,616 B2
(45) **Date of Patent: *Jul. 9, 2002**

(54) FIELD EMISSION DISPLAY DEVICES WITH REFLECTORS, AND METHODS OF FORMING FIELD EMISSION DISPLAY DEVICES WITH REFLECTORS

(75) Inventor: John Kichul Lee, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/870,852

(22) Filed: May 30, 2001

Related U.S. Application Data

(63) Continuation of application No. 09/197,026, filed on Nov. 20, 1998, now Pat. No. 6,252,348.

(51) Int. Cl.[7] ..... H01J 63/04
(52) U.S. Cl. ..... 313/495; 313/496
(58) Field of Search ..... 313/495, 496, 313/497, 422, 309, 336, 351; 315/169.4

(56) References Cited

U.S. PATENT DOCUMENTS

| | | | | |
|---|---|---|---|---|
| 5,191,217 A | | 3/1993 | Kane et al. | 313/309 |
| 5,448,133 A | * | 9/1995 | Ise | 313/497 |
| 5,866,979 A | | 2/1999 | Cathey, Jr. et al. | 313/496 |
| 5,975,975 A | | 11/1999 | Hofmann et al. | 445/24 |
| 6,020,683 A | | 2/2000 | Cathey, Jr. et al. | 313/497 |
| 6,252,348 B1 | * | 6/2001 | Lee | 313/495 |

FOREIGN PATENT DOCUMENTS

| | | | | |
|---|---|---|---|---|
| EP | 0 712 149 | * | 5/1996 | H01J/31/12 |

* cited by examiner

*Primary Examiner*—Michael H. Day
(74) *Attorney, Agent, or Firm*—Wells St. John P.S.

(57) ABSTRACT

In one aspect, the invention encompasses a field emission display device. The device comprises a base plate and a face plate which is over and spaced from the base plate. The device further comprises emitters associated with the base plate and phosphor associated with the face plate. Additionally, the device comprises a reflector associated with the base plate and having an upper reflective surface.

In another aspect, the invention encompasses a method of forming a field emission display device. A base plate is provided, and a pair of spaced emitter-containing regions are provided over the base plate. A reflector is formed over the base plate and between the spaced emitter-containing regions. A face plate is provided, and a pair of spaced phosphor-containing masses are formed in association with the face plate. The face plate and base plate are joined to one another with the face plate being aligned over the base plate and spaced from the base plate. After the joining, the spaced emitter-containing regions align under the spaced phosphor-containing masses, and the reflector aligns under the space between the spaced phosphor-containing masses.

37 Claims, 9 Drawing Sheets

FIELD EMISSION DISPLAY DEVICES WITH REFLECTORS, AND METHODS OF FORMING FIELD EMISSION DISPLAY DEVICES WITH REFLECTORS

RELATED PATENT DATA

This patent resulted from a continuation application of U.S. patent application Ser. No. 09/197,026, filed Nov. 20, 1998, now U.S. Pat. No. 6,252,348, issued Jun. 26, 2001.

PATENT RIGHTS STATEMENT

This invention was made with Government support under Contract No. DABT63-94-C-0012 awarded by Advanced Research Projects Agency (ARPA). The Government has certain rights in the invention.

TECHNICAL FIELD

The invention pertains to field emission display devices and methods of forming such devices. In a particular aspect, the invention pertains to methods of enhancing intensity of phosphor emissions of field emission display devices.

BACKGROUND OF THE INVENTION

For more than half a century, the cathode ray tube (CRT) has been the principal device for electronically displaying visual information. Although CRTs have been endowed during that period with remarkable display characteristics in the areas of color, brightness, contrast and resolutions they have remained relatively bulky and power hungry. The advent of portable computers has created intense demand for displays which are lightweight, compact, and power efficient. Liquid crystal displays (LCDs) are now used almost universally for lap-top computers. However, contrast is poor in comparison to CRTs, only a limited range of viewing angles is possible, and battery life is still measured in hours rather than days.

As a result of the drawbacks of LCD and CRT technology, field emission display (FED) technology has been receiving increased attention by industry. Flat panel displays utilizing FED technology employ a matrix-addressable array of cold, pointed field emission cathodes in combination with a luminescent phosphor screen. Somewhat analogous to a cathode ray tube, individual field emission structures are sometimes referred to as vacuum microelectronic triodes. Each triode has the following elements: a cathode (emitter tip), a grid (also referred to as the gate), and an anode (typically, the phosphor-coated element to which emitted electrons are directed).

FIG. 1 illustrates a cross-sectional view of a prior art field emission display device 10. Device 10 comprises a face plate 12, a base plate 14, and spacers 26 extending between base plate 14 and face plate 12 to maintain face plate 12 in spaced relation relative to base plate 14. Face plate 12, base plate 14 and spacers 26 can comprise, for example, glass. Phosphor regions 16, 18 and 20 are associated with face plate 12, and separated from face plate 12 by a transparent conductive layer 22. Transparent conductive layer 22 can comprise, for example, indium tin oxide or tin oxide. Phosphor regions 16, 18 and 20 comprise phosphor-containing masses. Each of phosphor regions 16, 18 and 20 can comprise a different color phosphor. Typically, phosphor regions 16, 18 and 20 comprise either red, green or blue phosphor. A black matrix material 24 is provided to separate phosphor regions 16, 18 and 20 from one another.

Base plate 14 has emitter regions 36, 38 and 40 associated therewith. The emitter regions comprise emitters 42 which are located within radially symmetrical apertures 44 (only some of which are labeled) formed through a conductive gate layer 46 and a lower insulating layer 48. Emitters 42 are typically about 1 micron high, and are separated from base 14 by a conductive layer 50. Emitters 42 and apertures 44 are connected with circuitry (not shown) enabling column and row addressing of the emitters 42 and apertures 44, respectively.

A voltage source 60 is provided to apply a voltage differential between emitters 42 and surrounding gate apertures 46. Application of such voltage differential causes electron streams 61, 62 and 63 to be emitted toward phosphor regions 16, 18 and 20, respectively. Conductive layer 22 is charged to a potential higher than that applied to gate layer 46, and thus functions as. an anode toward which the emitted electrons accelerate. Once the emitted electrons contact phosphor dots associated with regions 16, 18 and 20, light is emitted. As discussed above, the emitters 42 are typically matrix addressable via circuitry. Emitters 42 can thus be selectively activated to display a desired image on the phosphor-coated screen of face plate 12.

Typical phosphor arrangements associated with a face plate 12 are shown in FIGS. 2 and 3. Specifically, FIGS. 2 and 3 illustrate alternative embodiment face plates 12, with the face plates having red, green and blue phosphor regions (illustrated as regions labeled "R", "G", and "B", respectively), and black matrix areas 24 surrounding the phosphor regions. Also, the face plates have locations wherein spacers 26 are bound. The face plate of FIG. 2 corresponds to a display using Sony Trinitron® scanning, and the face plate construction of FIG. 3 corresponds to a phosphor/black matrix pattern of a conventionally-scanned color display.

The three phosphor colors (red, green, and blue) can be utilized to generate a wide array of screen colors by simultaneously stimulating one or more of the red, green and blue regions. The simultaneous stimulation of multiple regions generates a blend of colors. However, if the color blend is inaccurate, an incorrect color will be displayed. Also, an inaccurate color blend can cause a dirty, non-uniform appearance of a displayed image (a so-called "muddying" of the appearance of a displayed image). Inaccurate color blending can result from, for example, lost illumination efficiency. Illumination efficiency is a measure of the amount of light passed through face plate 12 and toward a viewer relative to the amount of electrons striking a phosphor region. Illumination efficiency is decreased if electrons strike a phosphor region and cause something other than light passing through face plate 12. For the above-discussed reasons, it would be desirable to develop methods and apparatuses which improve illumination efficiency and enhance blending of primary phosphor colors.

SUMMARY OF THE INVENTION

In one aspect, the invention encompasses a field emission display device. The device comprises a base plate and a face plate which is over and spaced from the base plate. The device further comprises emitters associated with the base plate, and phosphor associated with the face plate. Additionally, the device comprises a reflector associated with the base plate and having an upper reflective surface.

In another aspect, the invention encompasses a method of forming a field emission display device. A base plate is provided, and a pair of spaced emitter-containing regions are provided over the base plate. A reflector is formed over the base plate and between the spaced emitter-containing regions. A face plate is provided, and a pair of spaced phosphor-containing masses are formed in association with the face plate. The face plate and base plate are joined to one another with the face plate being aligned over the base plate and spaced from the base plate. After the joining, the spaced emitter-containing regions align under the spaced phosphor-containing masses, and the reflector aligns under the space between the spaced phosphor-containing masses.

BRIEF DESCRIPTION OF THE DRAWINGS

Preferred embodiments of the invention are described below with reference to the following accompanying drawings.

FIG. 4 is a diagrammatic, fragmentary, cross-sectional view of a field emission display device constructed in accordance with a method of the present invention.

DETAILED DESCRIPTION OF THE PREFERRED EMBODIMENTS

Figure 1:
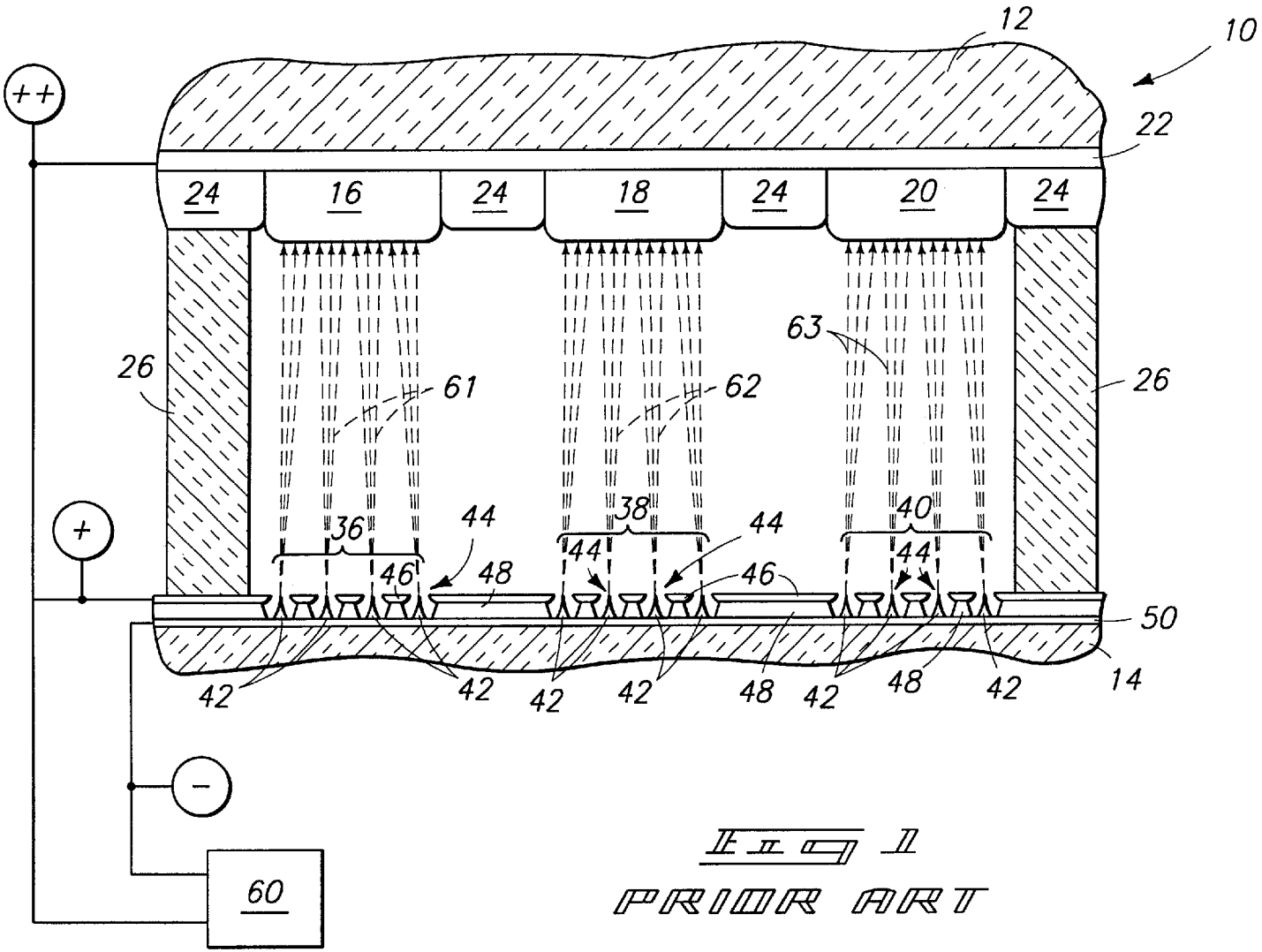
FIG. 1 PRIOR ART
FIG. 1 is a diagrammatic, cross-sectional, fragmentary view of a prior art field emission display device.
Figure 2:
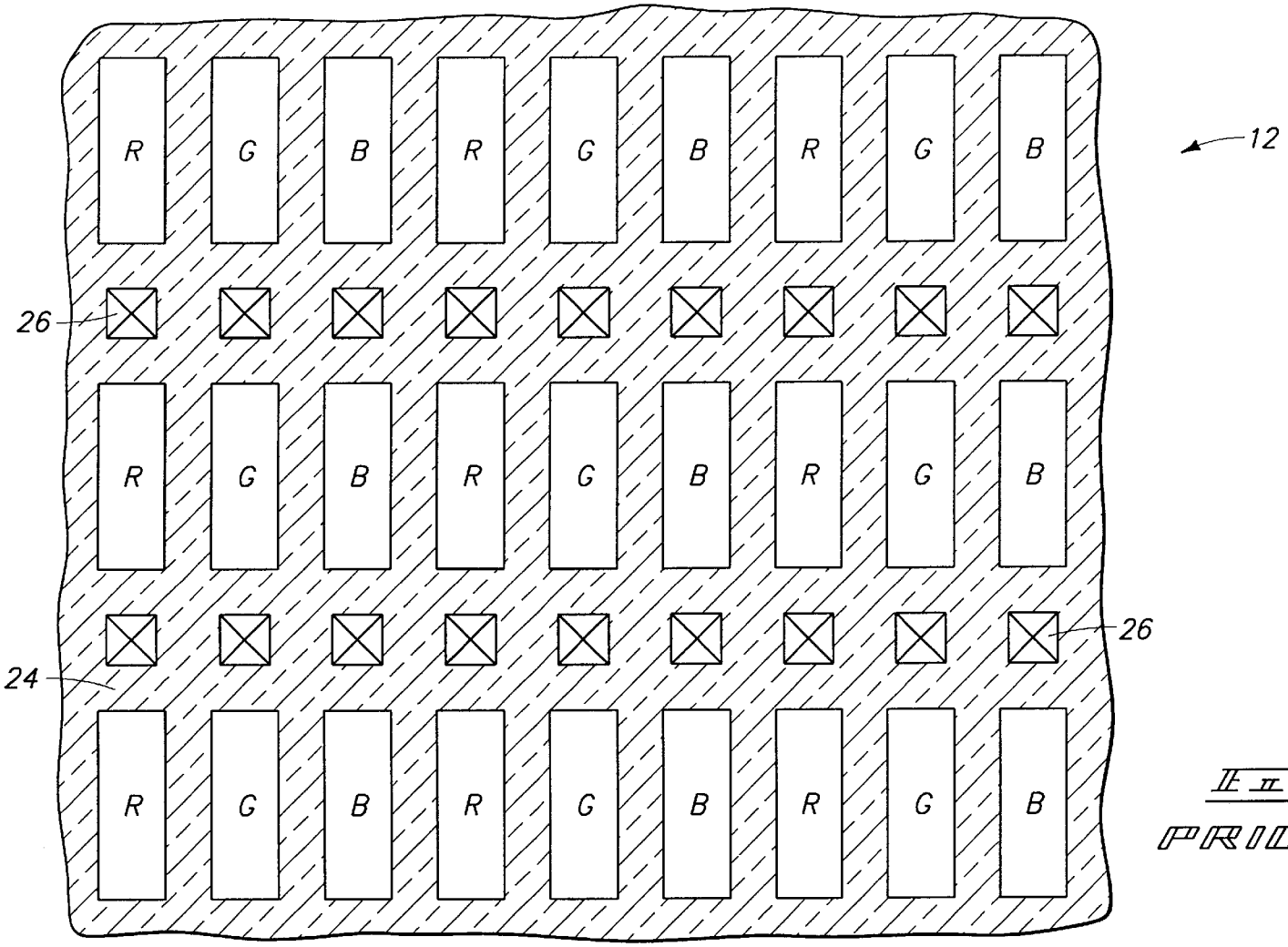
FIG 2 PRIOR ART
FIG. 2 is a top plan view of a "black" matrix pattern for a display using Sony Trinitron® scanning.
Figure 3:
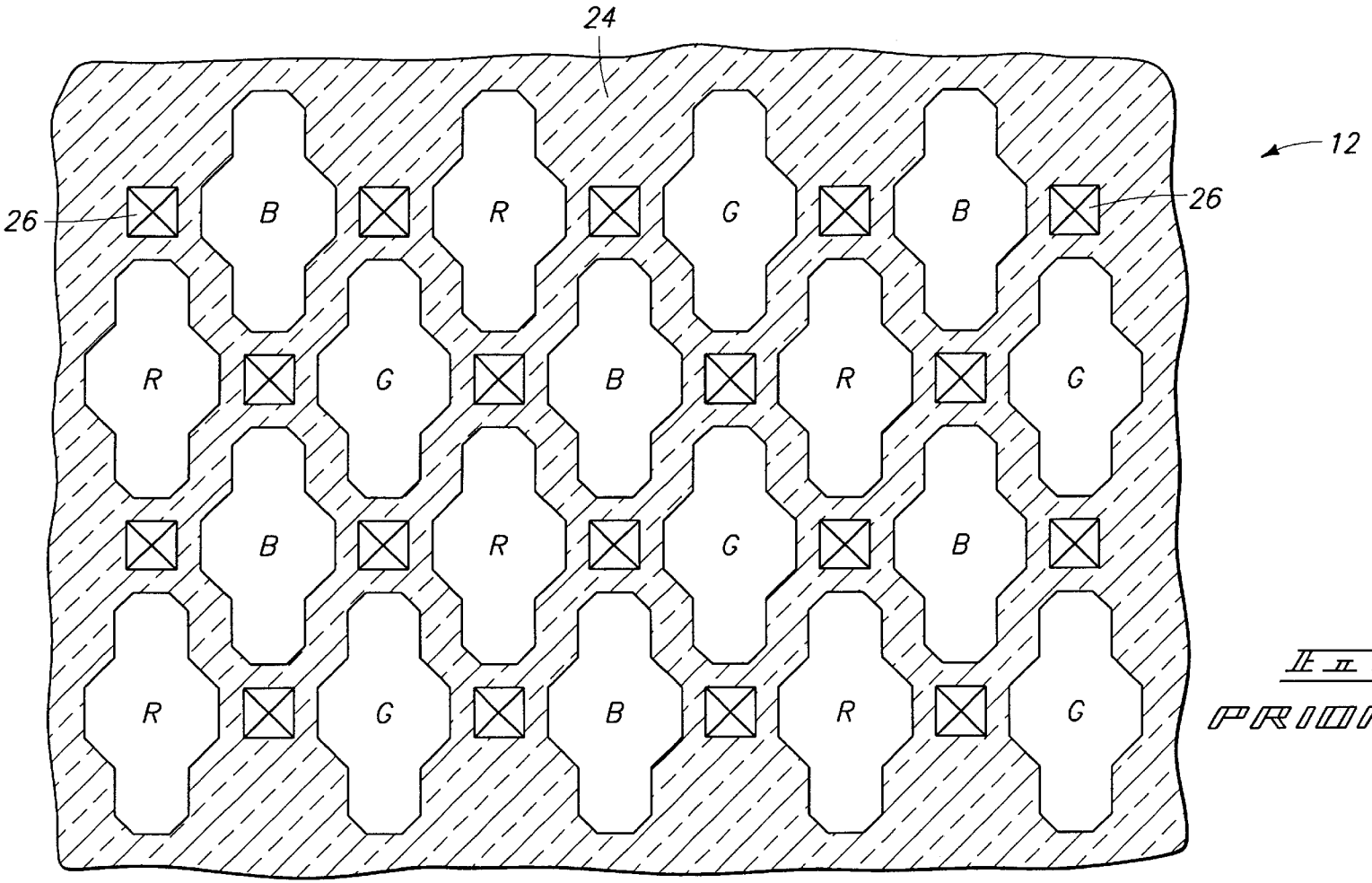
FIG 3 PRIOR ART
FIG. 3 is a top plan view of a "black" matrix pattern for a conventionally-scanned color display.

This disclosure of the invention is submitted in furtherance of the constitutional purposes of the U.S. Patent Laws "to promote the progress of science and useful arts" (Article 1, Section 8).

A field emission display device 10*a* encompassed by the present invention is shown in FIG. 4. In referring to FIG. 4, similar numbering to that utilized above in describing the device 10 of FIG. 1 will be used, with differences indicated by the suffix "a" or by different numerals. Device 10*a* comprises a face plate 12 and a base plate 14, as well as conductive layers 22 and 50 associated with face plate 12 and base plate 14, respectively. Device 10*a* further comprises phosphor regions 16, 18 and 20 associated with face plate 12, and emitter regions 36, 38 and 40 associated with base plate 14.

Device 10*a* differs from the field emission display device 10 of FIG. 1 in that device 10a further comprises reflectors 100 provided between emitter regions 36, 38 and 40. Reflectors 100 comprise a support material 102, and a reflective material 104 supported on material 102. In the shown embodiment, support material 102 comprises the same insulative material as lower insulating layer 48. However, it is to be understood that in other embodiments (not shown) support material 102 can comprise an insulative material different from the insulative material of layer 48, and in yet other embodiments support material 102 can comprise a conductive material, or can be eliminated entirely. Exemplary materials for support material 102 are silicon nitride, silicon oxide, amorphous silicon, and polysilicon. Reflective material 104 can comprise, for example, refractory metals. Specific examples of reflective materials which can be incorporated into reflective layer 104 are aluminum, chromium and copper. An exemplary thickness of reflective material 104 is from about 2,000 Å to about 4,000 Å. Reflective material 104 has an arcuate-shaped and reflective upper surface 106. An exemplary distance between an uppermost surface of reflective surface 106 and uppermost surfaces of emitters 42 is about 5,000 Å.

A second difference between field emission device 10*a* of FIG. 4 and the prior art device 10 of FIG. 1 is that black matrix material 24 is removed from between phosphor regions 16, 18 and 20 in device 10*a*. Methods for removal of such black matrix material are known to persons of ordinary skill in the art, and can include, for example, a selective etch of the black matrix material relative to the material of the phosphor masses at regions 16, 18 and 20. It is noted that the embodiment shown in FIG. 4 is merely an exemplary embodiment of a field emission device of the present invention, and the invention encompasses other embodiments (not shown) wherein black matrix material 24 remains between phosphor regions 16, 18 and 20. It is also noted that even though the black matrix material is removed from between the phosphor regions 16, 18 and 20, the black matrix material can still remain associated with other regions of face plate 12. For instance, in the shown embodiment the black matrix material 24 remains over spacers 26.

A third difference between field emission device 10*a* of FIG. 4 and the prior art device 10 of FIG. 1 is that the transparent material of conductive layer 22 is removed from between phosphor regions 16, 18 and 20 in the region overlying reflective surface 106. Methods for removal of such material are known to persons of ordinary skill in the art, and can include, for example, a selective etch of the material relative to the material of the phosphor masses at regions 16, 18 and 20. It is noted that the embodiment shown in FIG. 4 is merely an exemplary embodiment of a field emission device of the present invention, and the invention encompasses other embodiments (not shown) wherein conductive layer 22 remains between phosphor regions 16, 18 and 20. It is also noted that even though the conductive layer 22 is removed from over reflective surface 106, the conductive layer still remains associated with other regions of face plate 12. For instance, in the shown embodiment the conductive layer 22 remains connected with phosphor regions 16, 18 and 20. Also, the conductive material of layer 22 underlying each of phosphor regions 16, 18 and 20 remains interconnected through portions of layer 22 (not shown) extending between regions 16, 18 and 20, but not over reflective surface 106.

In operation, a charge is applied to emitters 42 from source 60 to cause emission of electron streams 61, 62 and 63. Electron streams 61, 62 and 63 stimulate light emission from phosphor masses at regions 16, 18 and 20 to emit photons 110 through face plate 12 and thereby display a viewable image. The emission of light waves from phosphor masses 16, 18 and 20 generally occurs in randomized directions. Accordingly, some of the emitted photons 110 are directed toward base plate 14, instead of outwardly through face plate 12. In prior art devices, such as the device 10 of FIG. 1, such downwardly-emitted photons are effectively lost. However, in the apparatus 10*a* of the present invention the downwardly-emitted photons 110 strike reflector surface 106 and are reflected back upwardly toward and through face plate 12. Accordingly, device 10*a* can have a higher illumination efficiency than the prior art device 10, as at least some of the downwardly-emitted photons that are lost in device 10 are effectively recovered by the reflective layer 104 of device 10a. The recovery of the downwardly-emitted photons can improve blending of light simultaneously emitted from multiple phosphor regions to alleviate incorrect color displays that occurred in prior art devices (such as the device 10 of FIG. 1).

Figure 5:
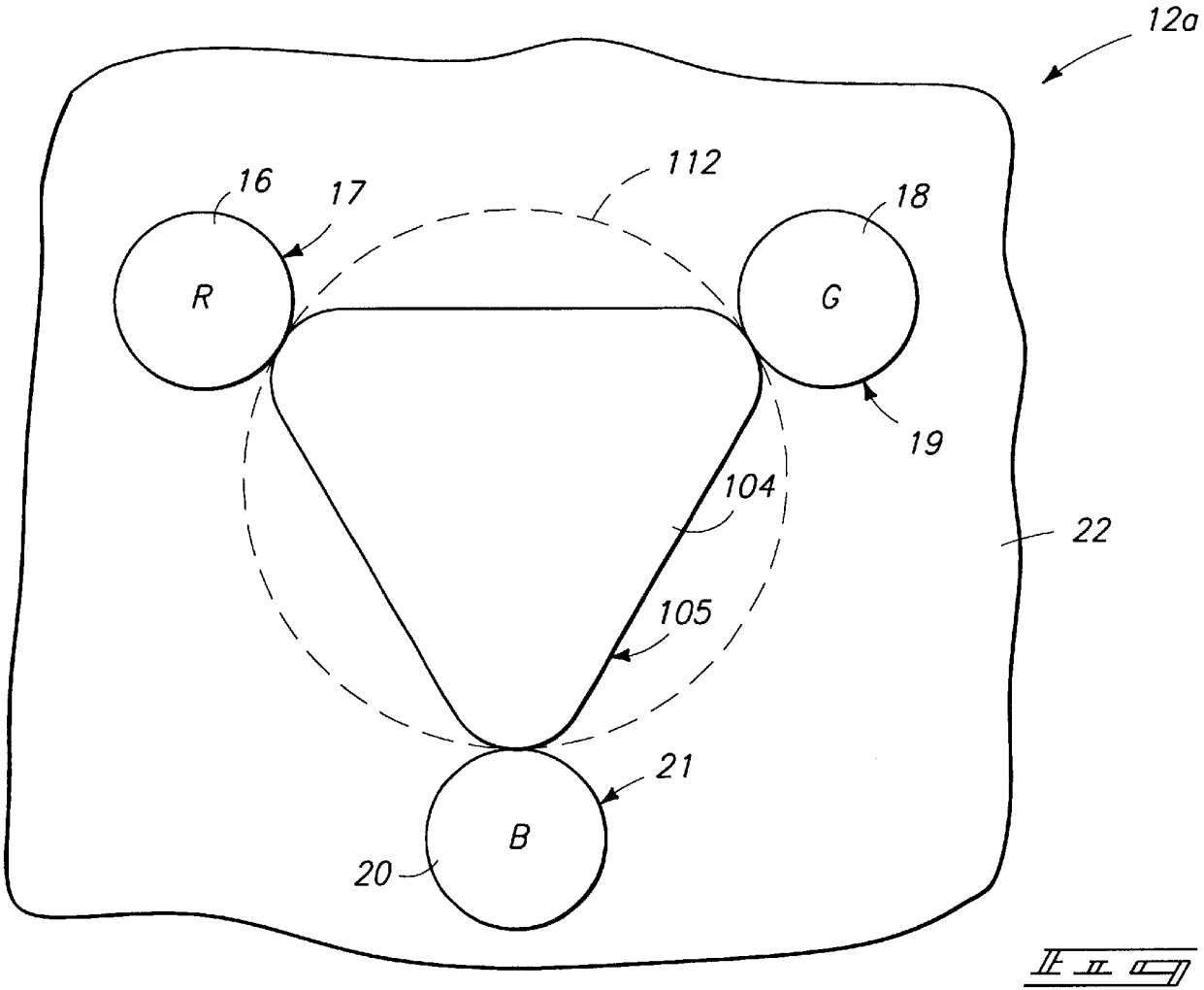
FIG. 5 is a plan view of a relative orientation of a reflector of the present invention aligned relative to red, green and blue phosphor regions.
Figure 6:
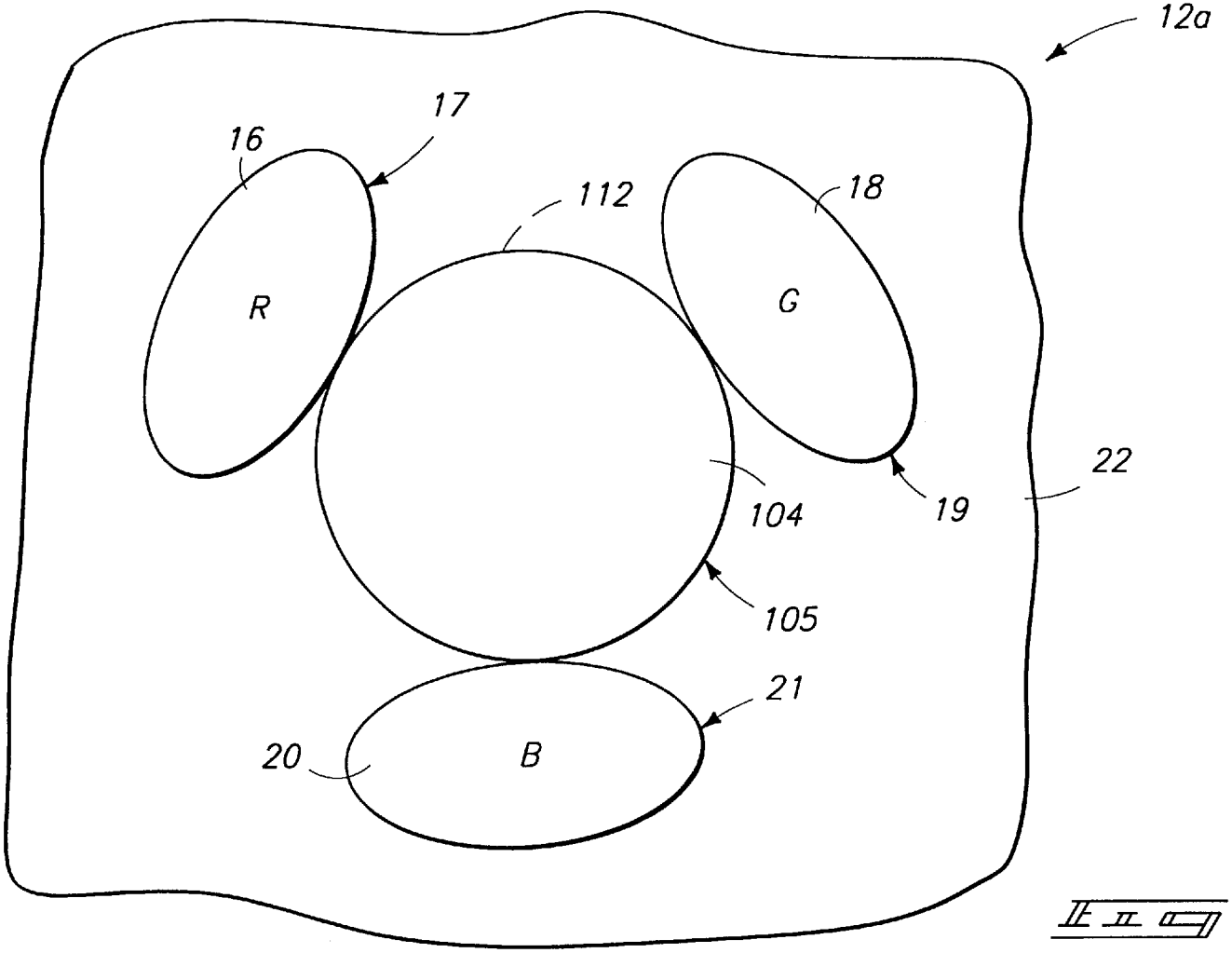
FIG. 6 is a plan view of a second embodiment reflector of the present invention aligned relative to red, green and blue phosphor regions.

FIGS. 5 and 6 illustrate plan views showing a superposition of a reflective layer 104 relative to red, green and blue phosphor regions. In referring to FIGS. 5 and 6, identical numbering to that utilized above in describing the embodiment of FIG. 4 will be used. FIG. 5 illustrates a first embodiment arrangement of reflective layer 104 relative to red, green and blue phosphor regions (16, 18 and 20, respectively). In the embodiment of FIG. 5, phosphor regions 16, 18 and 20 form a phosphor pattern, with a phosphor void region 112 (shown with a dashed line) defined to be intermediate phosphor regions 16, 18 and 20. Reflector 104 is aligned to overlay the phosphor void region 112. In the shown embodiment, phosphor regions 16, 18 and 20 comprise lateral peripheries 17, 19 and 21, respectively, and reflector 104 comprises a lateral periphery 105. Lateral periphery 105 of reflector 104 is aligned to be flush with each of the lateral peripheries 17, 19 and 21 of the red, green and blue phosphor regions. In other embodiments (not shown) lateral periphery 105 of reflector layer 104 can extend to overlap one or more of lateral peripheries 17, 19 and 21, or can be spaced from one or more of lateral peripheries 17, 19 and 21, so that periphery 105 is not flush with such one or more of lateral peripheries 17, 19 and 21.

The embodiment of FIG. 6 differs from that of FIG. 5 in that reflector 104 of FIG. 6 has a circular-shaped lateral periphery 105, rather than the triangular-shaped lateral periphery of FIG. 5. The embodiment of FIG. 6 further differs from that of FIG. 5 in that phosphor regions 16, 18 and 20 of FIG. 6 are elliptical in shape, while those of FIG. 5 are circular in shape. Particular shapes of phosphor regions 16, 18 and 20 can be determined by conventional methods, and the choice of elliptical, shaped phosphor regions or circular-shaped phosphor regions is a matter of design choice for persons of ordinary skill in the art. The circular-shaped reflector 104 of FIG. 6 overlaps substantially all of void region 112 (FIG. 5).

The views of FIGS. 5 and 6 illustrate exemplary embodiments for aligning a reflector region 104 associated with base plate 14 (FIG. 4) with phosphor regions 16, 18 and 20 associated with face plate 12 (FIG. 4). It is to be understood in referring to the views of FIGS. 5 and 6 that reflector 104 is elevationally spaced from phosphor regions 16, 18 and 20. Accordingly, in embodiments in which lateral periphery 105 of reflector 104 overlaps one or more of lateral peripheries 17, 19 and 21 in the above-described views of FIGS. 5 and 6, the lateral periphery 105 is in fact extending to under one or more of phosphor regions 16, 18 and 20 in the device of FIG. 4.

Figure 7:
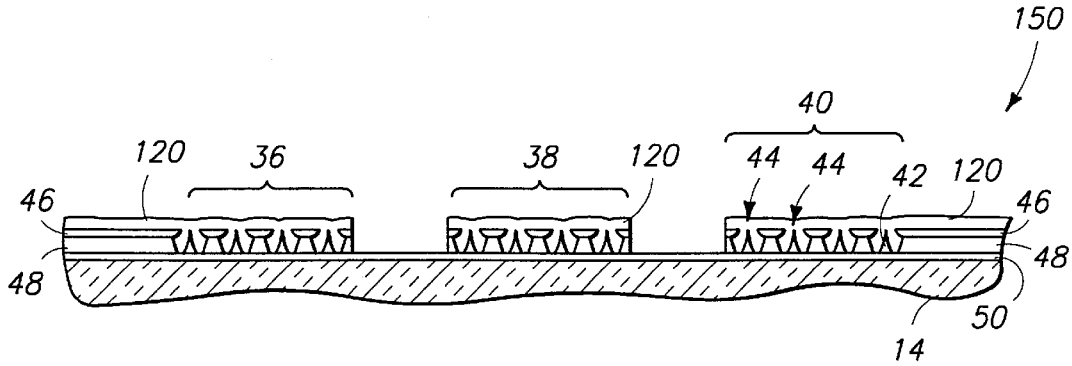
FIG. 7 is a fragmentary, diagrammatic, cross-sectional view of a field emission display base plate at a preliminary stage in forming a field emission display device in accordance with a method of the present invention.

Methods of forming the reflector layer 104 (FIG. 4) are described with reference to a base plate structure 150 in FIGS. 7–12. Referring first to FIG. 7, emitter base plate 14 is illustrated at a preliminary stage of a method of forming reflector 104 (FIG. 4). Conductive layer 50, insulative layer 48 and conductive layer 46 are formed over base plate 14 by conventional methods. Also, emitters 42 and apertures 44 are formed and patterned by conventional methods. A patterned material 120 is formed to cover portions of base 14, while leaving the areas between regions 36, 38 and 40 exposed. Patterned material 120 preferably comprises a material that is selectively etchable relative to layers 46 and 48, and can comprise, for example, photoresist. After formation of patterned material 120, the exposed areas between regions 36, 38 and 40 are subjected to etching conditions to remove layers 46 and 48 from the exposed areas.

Figure 8:
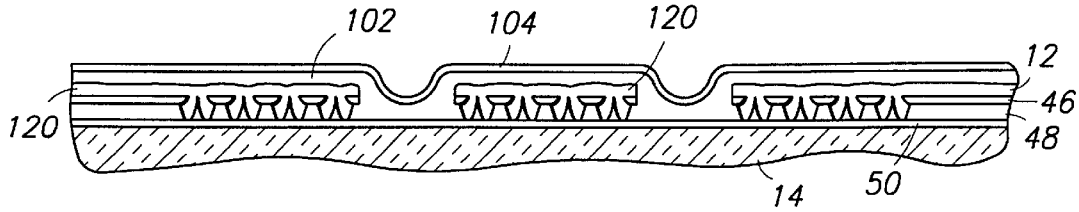
FIG. 8 is a view of the FIG. 7 base plate at a processing step subsequent to that of FIG. 7.

Referring to FIG. 8, support material 102 is provided over base 14, and reflective material 104 is provided over support material 102.

Figure 9:
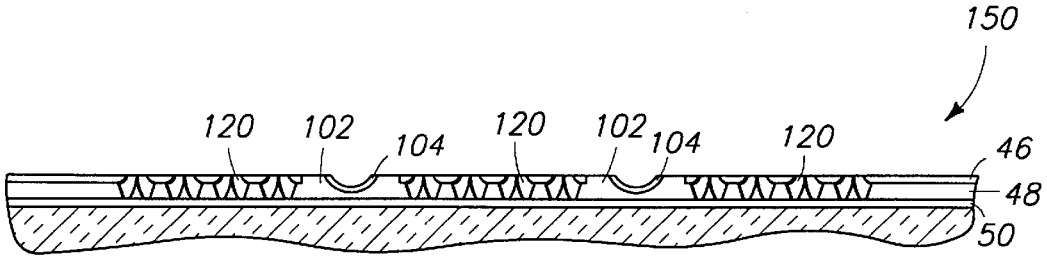
FIG. 9 is a view of the FIG. 7 base plate at a processing step subsequent to that of FIG. 8.

Referring to FIG. 9, the structure of FIG. 8 is shown after being subjected to planarization (such as, for example, chemical-mechanical planarization), which removes layers 102, 104 and 120 from over conductive material 46.

Figure 10:
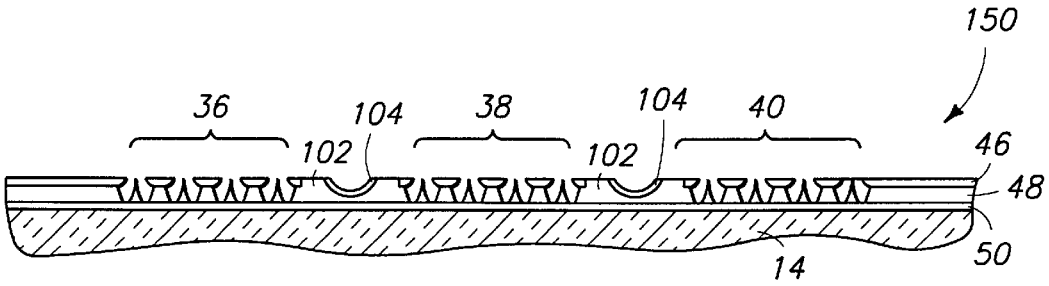
FIG. 10 is a view of the FIG. 7 base plate at a processing step subsequent to that of FIG. 9.
Figure 11:
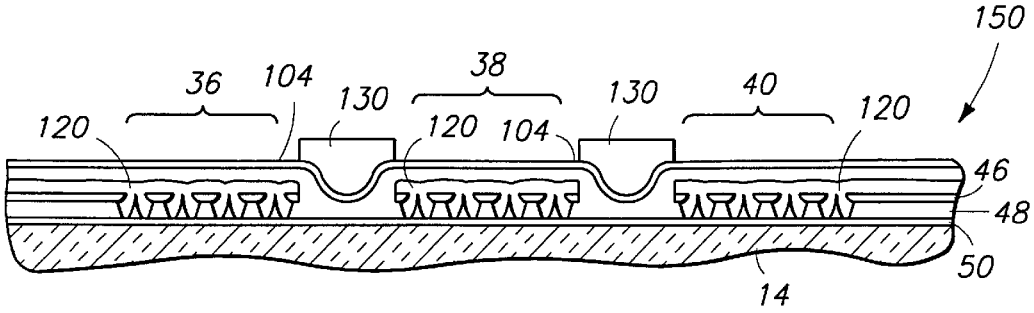

Referring next to FIG. 10, material 120 is removed to form a resulting structure having a reflective material 104 extending between emitter regions 36, 38 and 40.

Figure 11:
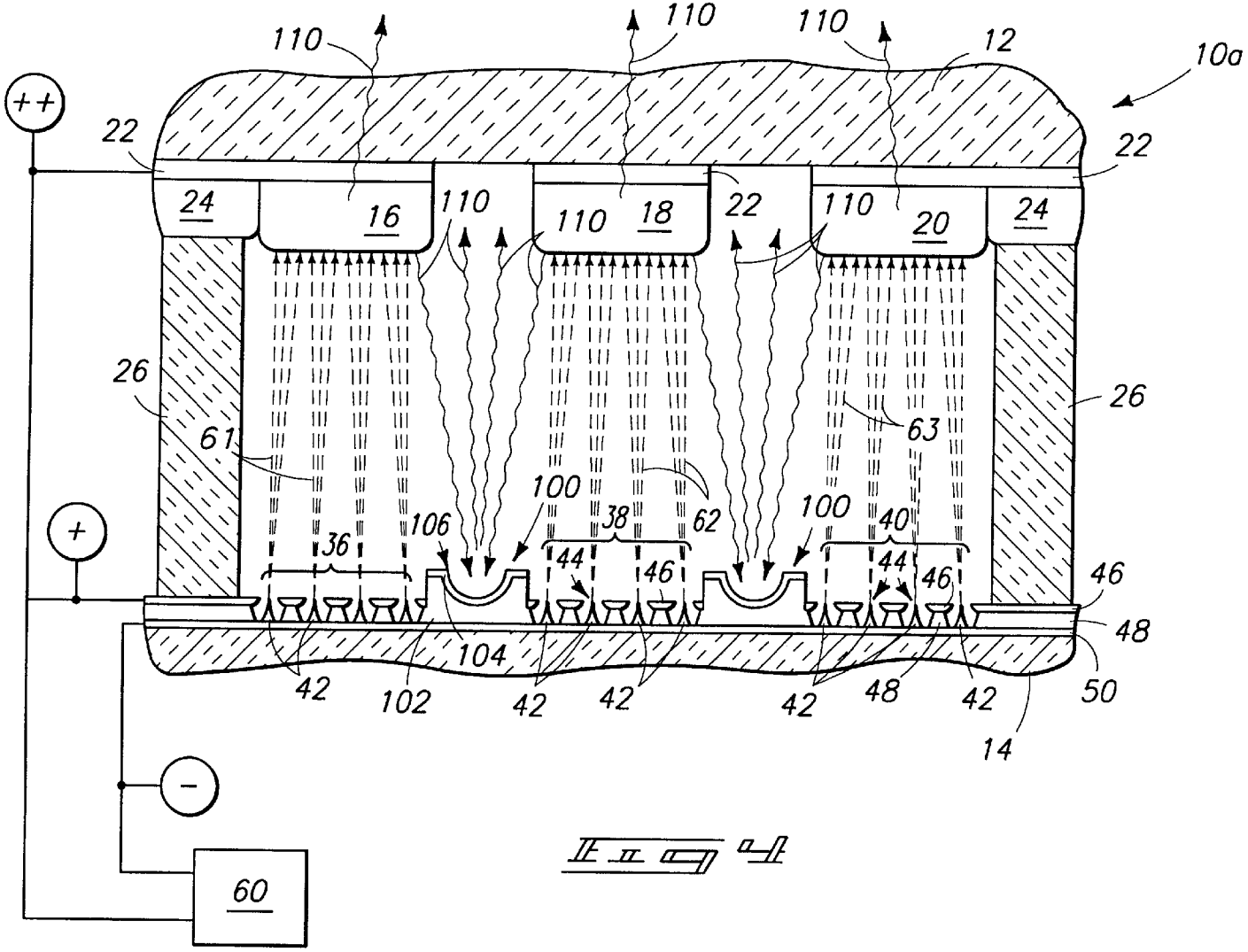
FIG. 11 is a view of the base plate of FIG. 8 shown at a second embodiment processing step subsequent to that of FIG. 8.
Figure 12:
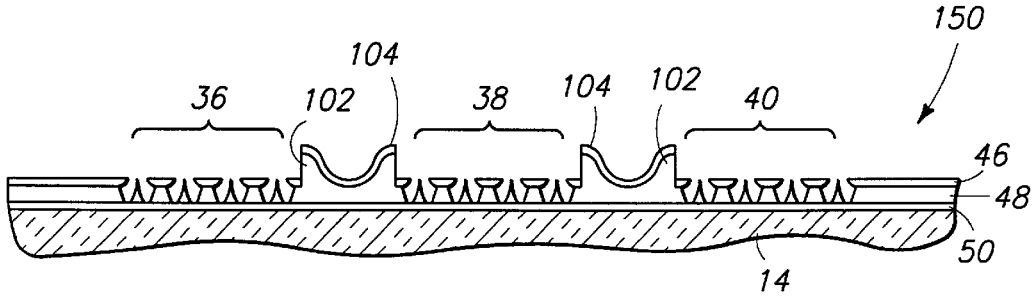
FIG. 12 is a view of the base plate of FIG. 8 shown at a processing step subsequent t o t hat of FIG. 11.

FIGS. 11 and 12 illustrate an alternative embodiment for forming reflectors 106 (FIG. 4) between regions 36, 38 and 40. FIG. 11 illustrates structure 150 at a processing step subsequent to that shown in FIG. 8. Specifically, a patterned masking layer 130 is provided over reflective layer 104 in areas between regions 36, 38 and 40. Masking layer 130 can comprise, for example, photoresist.

Referring to FIG. 12, layers 104 and 102 exposed between pattern masks 130 are removed, as is material 120. Subsequently, masks 130 (FIG. 11) are removed to form the shown structure 150. Structure 150 can then be incorporated into an FED apparatus to form an apparatus analogous to that described above with reference to FIG. 4.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A field emission display device comprising:

a base plate;

a material over the base plate and defining openings;

a face plate over and spaced from the base plate;

emitters associated with the base plate and formed in the openings of the material;

phosphor associated with the face plate; and a reflector associated with the base plate, the reflector having an upper reflective surface spaced from the openings.

2. The field emission display device of claim 1 wherein the phosphor is in a phosphor pattern, the phosphor pattern comprising three different phosphor regions spaced from one another, the pattern comprising a phosphor-void region intermediate the three different phosphor regions; and wherein the phosphor-void region overlays the reflector.

3. The field emission display device of claim 2 wherein the reflector upper surface has a lateral periphery and each of the three different phosphor regions has lateral peripheries, and wherein the reflector upper surface lateral periphery aligns to flush with each of the three different phosphor region lateral peripheries.

4. The field emission display device of claim 2 further comprising a transparent conductive material interconnecting the phosphor regions, and wherein the phosphor-void region is also void of the transparent conductive material.

5. The field emission display device of claim 2 further comprising a black matrix material associated with the face plate, and wherein the phosphor-void region is also void of the black matrix material.

6. The field emission display device of claim 2 wherein the reflector upper surface has a lateral periphery which extends to under each of the three different phosphor regions.

7. The field emission display device of claim 2 wherein the three different phosphor regions comprise different types of phosphor from one another.

8. The field emission display device of claim 2 wherein the reflector has a triangular-shaped lateral periphery.

9. The field emission display device of claim 2 wherein the reflector has a circular-shaped lateral periphery.

10. The field emission display device of claim 2 wherein one of the three different phosphor regions is a blue region, another is a red region and another is a green region.

11. The field emission display device of claim 1 wherein the reflective surface comprises aluminum.

12. The field emission display device of claim 1 wherein the reflective surface comprises one or more of aluminum, chromium and copper.

13. The field emission display device of claim 1 wherein the upper reflective surface comprises an arcuate shape.

14. The field emission display device of claim 1 wherein the emitters have uppermost surfaces and wherein the upper reflective surface is above the emitter uppermost surfaces.

15. The field emission display device of claim 1 comprising a plurality of the reflectors.

16. The field emission display device of claim 1 wherein the supper reflective surface comprises a plurality of non-planar surface portions.

17. A field emission display device comprising:

a base plate;

a face plate over and spaced from the base plate;

emitters associated with the base plate;

phosphor associated with the face plate; and a reflector associated with the base plate, the reflector having an upper reflective surface comprising a triangular-shaped lateral periphery.

18. The field emission display device of claim 17 wherein the reflective surface comprises aluminum.

19. The field emission display device of claim 17 wherein the reflective surface comprises one or more of aluminum, chromium and copper.

20. The field emission display device of claim 17 wherein the upper reflective surface comprises an arcuate shape.

21. The field emission display device of claim 17 wherein the emitters have uppermost surfaces and wherein the upper reflective surface is above the emitter uppermost surfaces.

22. The field emission display device of claim 17 comprising a plurality of the reflectors.

23. A method of enhancing intensity of one or more phosphor regions of a field emission display device comprising:

providing field emission display device comprising spaced emitter-containing regions and spaced phosphor-containing regions above the emitter regions;

providing a reflector between the spaced emitter-containing regions and under the space between the spaced phosphor-containing regions;

emitting radiation from the emitter-containing regions to stimulate phosphor at the phosphor-containing regions, the stimulated phosphor emitting light of an intensity;

directing a portion of the emitted light to the reflector;

reflecting the portion of the reflected light from the reflector, the reflected portion combining with light emitted from the stimulated phosphor to enhance the intensity of the emitted light; and wherein the reflector has a triangular-shaped lateral periphery.

24. The method of claim 23 wherein the phosphor-containing regions are provided as three phosphor-containing regions separated by a phosphor-void region; and wherein the phosphor-void region overlays the reflector.

25. The method of claim 23 wherein the reflector upper surface has a lateral periphery and each of the three phosphor-containing regions has lateral peripheries, and wherein the reflector upper surface lateral periphery aligns to flush with each of the three different phosphor region lateral peripheries.

26. The method of claim 23 further comprising a transparent conductive material interconnecting the phosphor regions, and wherein the phosphor-void region is also void of the transparent conductive material.

27. The method of claim 23 wherein the phosphor is associated with a face plate and further comprising a black matrix material associated with the face plate, and wherein the phosphor-void region is also void of the black matrix material.

28. The method of claim 23 wherein the reflector upper surface has a lateral periphery which extends to under each of the three phosphor-containing regions.

29. The method of claim 23 wherein the three phosphor-containing regions comprise different types of phosphor from one another.

30. The method of claim 23 wherein one of the three phosphor-containing regions is a blue region, another is a red region and another is a green region.

31. A method of forming a field emission display device comprising:

providing a base plate;

providing a face plate over and spaced from the base plate;

providing emitters associated with the base plate;

providing a plurality of phosphor masses associated with the face plate and provided to emit light upon stimulation, each phosphor mass spaced from an other phosphor mass to leave exposed portions of the face plate relative the base plate; and providing at least one reflector associated with the base plate and configured to reflect a portion of the emitted light to the exposed portions of the face plate.

32. The method of claim 31 wherein the reflector is supported upon electrically insulative material.

33. The method of claim 31 wherein the reflector is supported upon material comprising at least one of silicon nitride, silicon oxide, amorphous silicon and polysilicon.

34. The method of claim 31 wherein the reflector is supported upon electrically conductive material.

35. The method of claim 31 further comprising:

emitting radiation from the emitters to stimulate the phosphor masses and to provide the portion of the emitted light; and reflecting the portion of the emitted light between the phosphor masses.

36. The method of claim 31 wherein the reflector comprises refractory metal, and wherein the refractory metal comprises at least one of aluminum, chromium and copper.

37. A method of enhancing intensity of one or more phosphor regions of a field emission display device comprising:

providing field emission display device comprising spaced emitters and spaced phosphor-containing regions above the emitters;

providing a reflector between the spaced emitters;

emitting radiation from the emitters to stimulate phosphor at the phosphor-containing regions, the stimulated phosphor emitting light of an intensity;

directing a portion of the emitted light to the reflector; and focusing the directed portion of the emitted light between the spaced phosphor-containing regions to enhance the intensity of the emitted light.

* * * * *

UNITED STATES PATENT AND TRADEMARK OFFICE

CERTIFICATE OF CORRECTION

PATENT NO. : 6,417,616 B2
DATED : July 9, 2002
INVENTOR(S) : John Kichul Lee

It is certified that error appears in the above-identified patent and that said Letters Patent is hereby corrected as shown below:

Column 2,
Line 15, replace "layer 46, and thus functions as. an anode" with
-- layer 46, and thus functions as an anode --

Column 3,
Line 45, replace "processing step subsequent t o t hat" with
-- processing step subsequent to that --

Column 7,
Line 40, replace "the supper reflective surface" with -- the upper reflective surface --

Signed and Sealed this

Fourth Day of March, 2003

JAMES E. ROGAN
*Director of the United States Patent and Trademark Office*